United States Patent [19]

Klumpyan et al.

[11] Patent Number: 4,605,062

[45] Date of Patent: Aug. 12, 1986

[54] SUBSURFACE INJECTION TOOL

[75] Inventors: Joseph N. Klumpyan; Richard J. Ross, both of Houston, Tex.

[73] Assignee: Baker Oil Tools, Inc., Orange, Calif.

[21] Appl. No.: 742,994

[22] Filed: Jun. 10, 1985

[51] Int. Cl.[4] ..... E21B 33/124; E21B 34/14; E21B 43/14; E21B 23/06

[52] U.S. Cl. ..... 166/127; 166/128; 166/129; 166/131; 166/194; 166/324; 166/332

[58] Field of Search ..... 166/120, 127, 128, 129, 166/131, 142, 193, 194, 324, 332, 330

[56] References Cited

U.S. PATENT DOCUMENTS

| | | | |
|---|---|---|---|
| Re. 25,639 | 9/1964 | Clark, Jr. et al. | 166/129 |
| Re. 26,085 | 9/1966 | Myers | 166/120 |
| 2,042,817 | 6/1936 | Wilcox | 166/127 |
| 2,227,539 | 1/1941 | Dorton | 166/193 X |
| 3,008,523 | 11/1961 | Clark, Jr. et al. | 166/120 X |
| 3,112,795 | 12/1963 | Keithahn | 166/120 |
| 3,398,796 | 8/1968 | Fisher, Jr. et al. | 166/120 |
| 3,412,799 | 11/1968 | Ellis | 166/131 X |
| 3,434,538 | 3/1969 | Kilgore et al. | 166/131 X |
| 3,517,743 | 6/1970 | Pumpelly et al. | 166/127 |
| 3,861,465 | 1/1975 | Mignotte | 166/127 X |
| 4,258,787 | 3/1981 | Amancharla | 166/120 |
| 4,567,944 | 2/1986 | Zunkel et al. | 166/120 |

*Primary Examiner*—Stephen J. Novosad
*Assistant Examiner*—John F. Letchford
*Attorney, Agent, or Firm*—Norvell & Associates

[57] ABSTRACT

An injection tool for use in injecting fluids through perforations in the well bore of an oil or gas well is mechanically set and mechanically releasable. Fluid can be injected between upper and lower packing elements into a selected perforation. The upper and lower packing elements on opposite sides of the perforation into which fluid is injected are retractable, and any pressure differential across the upper packing elements or across the lower packing elements can be separately equalized.

20 Claims, 13 Drawing Figures

SUBSURFACE INJECTION TOOL

BACKGROUND OF THE INVENTION

1. FIELD OF THE INVENTION: This invention relates to a subsurface well tool for use in oil and gas wells, for use in injecting fluids into perforations within the well bore; more specifically, to a well tool mechanically set by manipulation of a tubing string, and providing for pressure equalization across packing elements on opposite sides of a perforation to facilitate release of the well tool.

2. DESCRIPTION OF THE PRIOR ART: It is often necessary to inject fluids, such as water, acid, or various types of chemicals, into an underground formation through perforations in the casing which provides for communication between the formation and the well bore. Most conventional injection tools can be used to inject fluids into the perforations contained within a specified interval of a well. Normally these tools require the use of two tools, one above the interval and one below the interval, connected together to permit fluid injection. Thus, a packer can be secured to a ported tubing section which is in turn secured to a lower packer, thus, providing isolation for the intermediate interval. However, these tools are suitable only for injecting fluids into intervals of six feet or greater. These tools generally are not suitable for injecting fluids into intervals as small as six inches, which may be desirable if fluids must be selectively injected into closely adjacent perforations. The conventional multipacker device is unsuitable for use in injecting fluids into such small intervals, because the mechanism necessary to set each packer renders it virtually impossible to position the packers closely adjacent each other.

One tool which can be used to inject fluids into a well is a modified version of the tool shown in U.S. Pat. No. Re. 25,639. As depicted in that patent, the packer shown therein would not be suitable for radial injection through the tubing string and out the mandrel. However, a radially extending mandrel port has been employed on tools similar to that shown in U.S. Pat. No. Re. 25,639 to accommodate such fluid injection

SUMMARY OF THE INVENTION

This invention relates to a tool for use in a well bore for producing hydrocarbons through a tubing string from a subterranean hydrocarbon-bearing formation. The tool includes a tubular body assembly, and, mounted on such assembly upper and lower packing elements, each suitable for sealing the annular area between tubing string and a casing or liner upon axial compression and radial expansion of the packing element. The packing elements can be set by longitudinal manipulation of a mandrel which can be attached to the tubing string and is insertable in the tubular body assembly. An injection path is established through a port in the mandrel between the bore of the mandrel and the exterior of the tool. An outer injection port communicating with the mandrel injection port is established in the tubular body assembly between the upper and lower packing elements. When a removable plug is positioned in the mandrel below the injection port, fluid can be injected through the mandrel and through a small interval between the upper and lower packing elements. A longitudinal bypass on the exterior of the tool mandrel provides a path for releasing annulus pressure acting on the expanded packing elements to permit the tools to retract. Seals are provided to seal this bypass until longitudinal movement of the mandrel shifts the seals to open the longitudinal bypass above and below the injection tool.

DETAILED DESCRIPTION OF THE PREFERRED EMBODIMENT

Figure 1A:
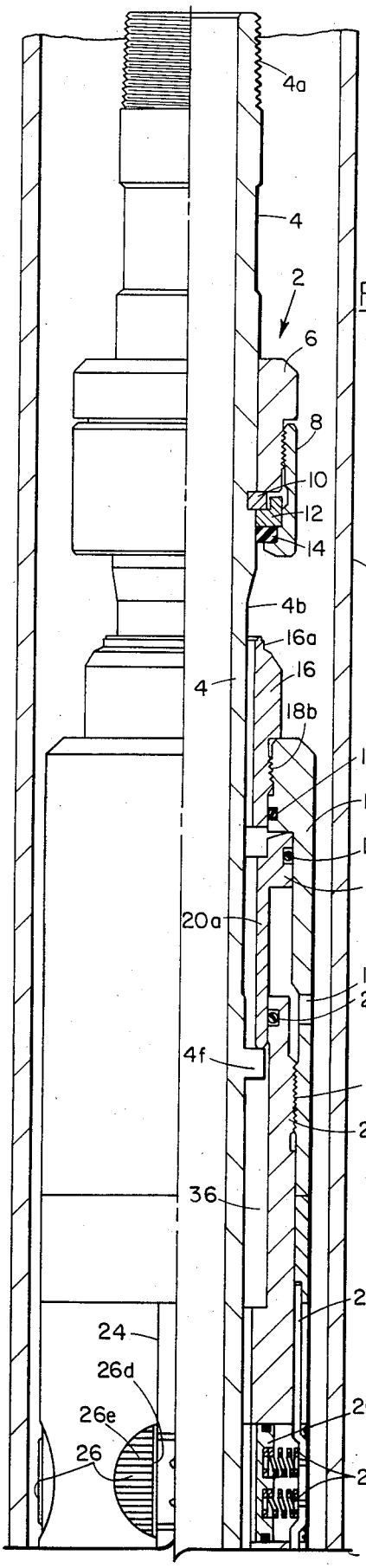
FIGS. 1A through 1D comprise longitudinal continuations, vertical sectional views of the injection tool in its retracted configuration.
Figure 1B:
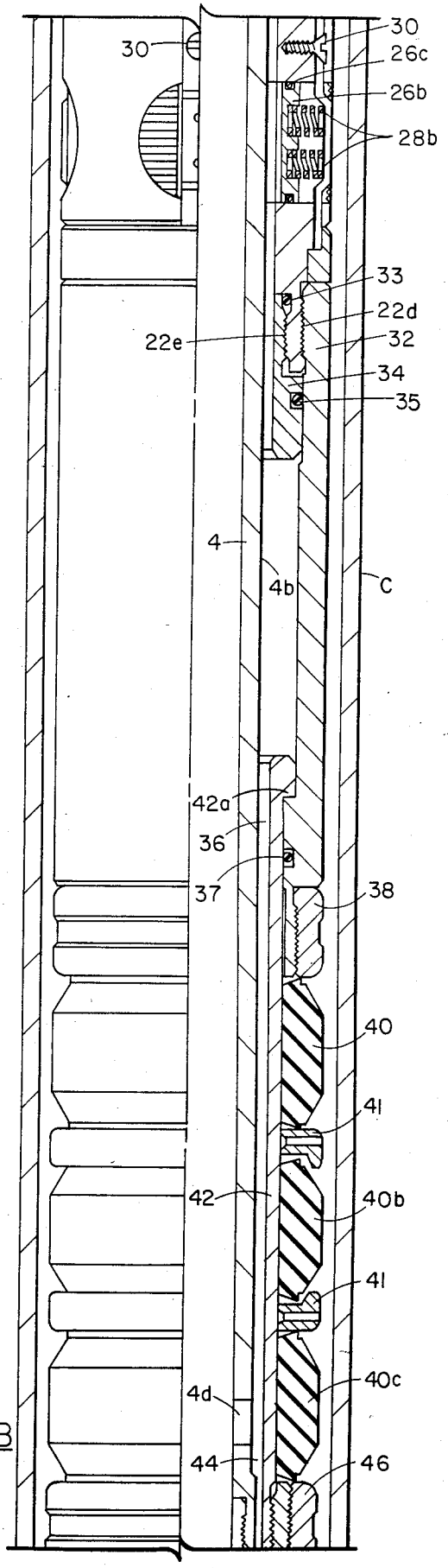
Figure 1C:
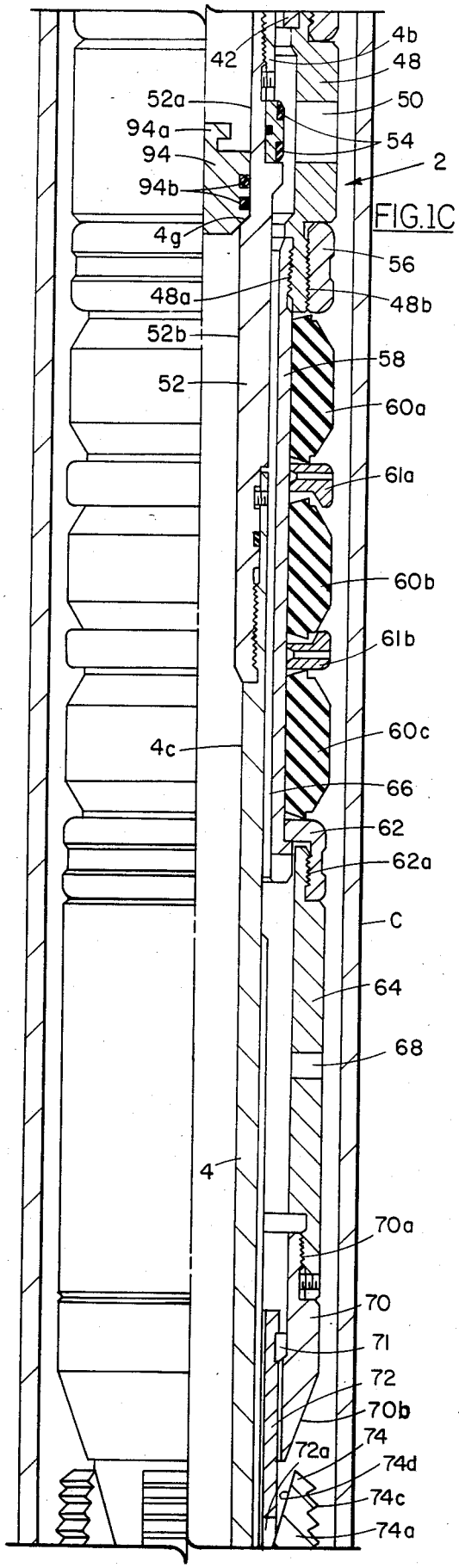
Figure 1D:
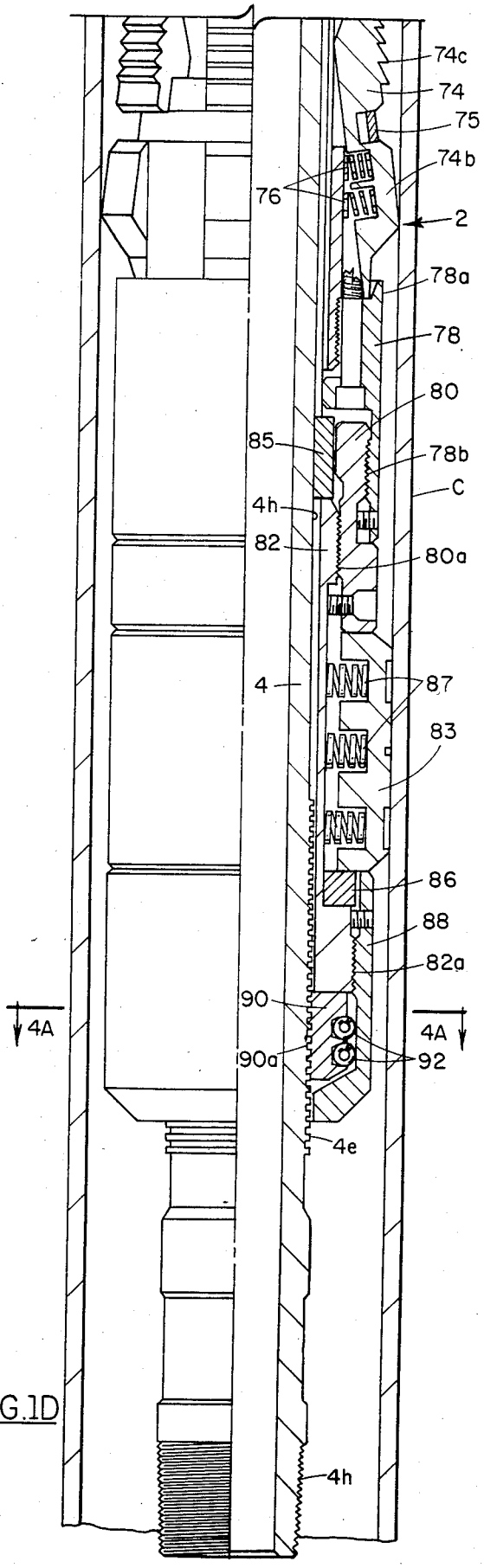
Figure 2A:
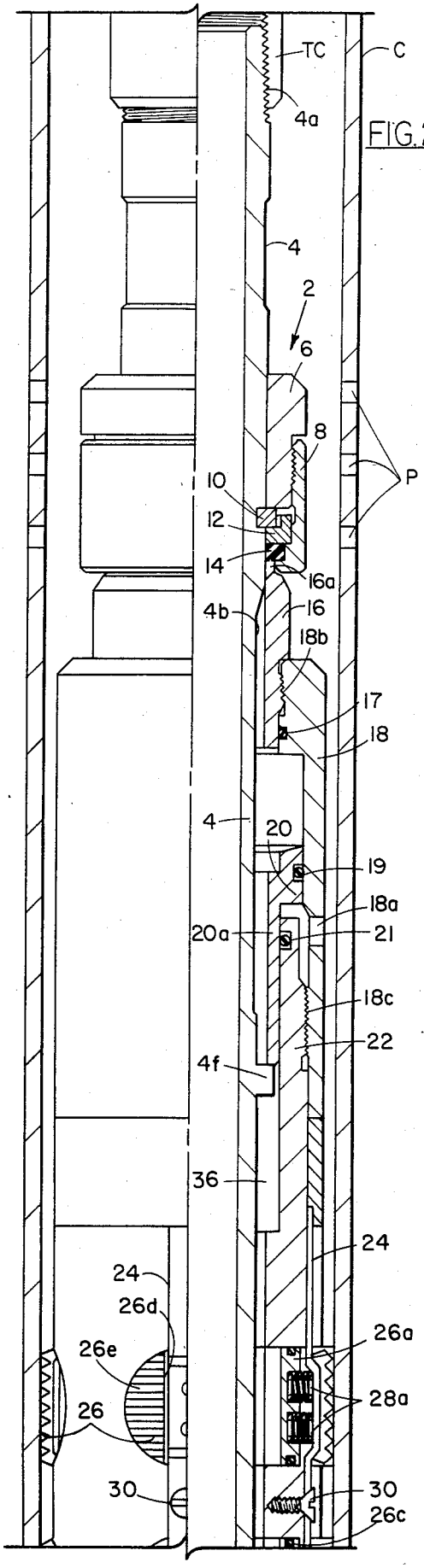
FIGS. 2D through 2D comprise longitudinal continuations, vertical sectional views of the injection tool positioned to inject fluids into the perforations in the casing communicating with a subterranean formation.

As seen in FIGS. 1A through 1D, the injection tool 2 includes a rigid mandrel assembly 4 which can be attached to a conventional tubing string extending between the surface of the well and the location of the injection tool. Conventional threads **4*a* located at the top of the mandrel 4 are used to secure mandrel assembly 4 to a tubing string. One means of securing the injection tool to the tubing string is a conventional coupling TC, as seen in FIG. 2A. Mandrel assembly 4** comprises a tubular structure having a mandrel bore extending therethrough communicable with the tubing string.

An upper unloader seal assembly including an annular elastomeric seal 14 is positioned adjacent the upper end of the mandrel 4. This upper unloader seal assembly comprises an upper seal retainer 6 secured to a lower seal retainer 8 by means of a threaded connection therebetween. A split ring retainer 10 held within an annular groove on the exterior of mandrel 4 engages the upper seal retainer member 6 and also engages a seal spacer 12. The retainer ring 10 and the seal spacer 12 are trapped between the upper seal retainer 6 and the lower seal retainer 8. Lower seal retainer 8 has a lower shoulder extending radially inwardly over a portion of the annular elastomeric upper seal ring 14 to hold the seal ring firmly secured around the exterior of mandrel 4.

Immediately below the upper seal assembly, including seal 14, the exterior of the mandrel 4 slopes inwardly to an outer diameter equivalent to that in section **4*b*. The outer diameter and thickness of the mandrel 4 remains essentially the same as shown at section 4*b* for that portion of the mandrel extending from the upper seal assembly to the lower end of the mandrel. A hydraulic hold-down housing 18 forming a portion of the exterior housing of the injection tool 2 extends around the upper portion of the mandrel section 4*b* and is attached by means of a threaded connection 18*b* to a cylindrical seal compressor 16. A rim 16*a* located at the upper end of seal compressor 16 has a reduced thickness and is opposed to the elastomeric seal 14. Seal compressor 16 is radially spaced from the exterior surface of mandrel section 4***b* by an amount sufficient to be radially coextensive with elastomeric seal 14.

A port 18*a* extends through the exterior of housing section 18 and communicates with a cavity formed between the outer housing section 18 and a balance sleeve 20. Conventional seals 19 and 21 establish sealing integrity with balance sleeve 20. The diameter of O-ring seal 19 and the surface which it engages is greater than the diameter of O-ring seal 21 and the surface which it engages, thus creating a net pressure area on balance sleeve 20. Balance sleeve 20 is spaced from the mandrel 4 below the seal compressor 16. In FIG. 1A, balance sleeve 20 is located in its uppermost position. The bottom end of balance sleeve 20 engages a radially outwardly protruding lug 4*f* forming a part of the exterior of mandrel 4. Hydraulic hold-down receptacle 22 is positioned on the interior of the outer housing 18 and is secured thereto by threads 18*c* located adjacent the upper end of the hydraulic hold-down receptacle 22. O-ring 21 is positioned within an inner groove on hydraulic hold-down receptacle 22 and a reduced diameter lower section 20*a* of balance sleeve 20 contacts the inner surface of hydraulic seal receptacle 22. The receptacle 22 constitutes the upper portion of what may be called the tubular body assembly of the tool.

The hydraulic seal receptacle 22 has a plurality of radially extending cylindrical apertures, each containing a hydraulic hold-down piston or button 26. In the preferred embodiment of this invention, a plurality of hold-down buttons are positioned circumferentially around the injection tool. As shown in FIGS. 1A and 1B, a pair 26*a* and 26*b* of hold-down buttons are positioned one above the other at each circumferential position. The hold-down buttons are shown in FIGS. 1A and 1B in their retracted position. A retainer bracket 24 secured to the receptacle 22 extends longitudinally over the exterior of each hold-down button 26. The retainer bracket 24 is secured to the receptacle or body 22 by a plurality of flat-head screws 30. A pair of springs 28*a* and 28*b* engages each of the hold-down buttons 26*a* and 26*b* at each circumferential location. The hold-down buttons 26*a* and 26*b* each have an O-ring 26*c* extending therearound engaging radial cylinders defined in receptacle 22. Each hold-down button or piston is cylindrical and has a longitudinally extending groove 26*d* for receiving springs 28 and through which the bracket 24 extends.

An upper intermediate housing or body section 32 is attached to the hydraulic hold-down seal receptacle 22 by a threaded connection 22*d* and an O-ring seal retainer 34 is in turn secured to hydraulic hold-down receptacle 22 by internal threads 22*e* with O-rings 33 and 35 establishing sealing integrity. An upper portion 36 of a longitudinally extending bypass area is defined on the interior of the upper intermediate housing or body 32 and extends between the mandrel 4 and the seal receptacle 22 upwardly through the balance sleeve 20 and through the seal compressor 16 to communicate with the exterior of the injection tool in the configuration shown in FIGS. 1A and 1B.

A packing element mandrel 42 having an opposing shoulder 42*a* engaging the lower end of upper intermediate housing 32 extends concentrically relative to the inner mandrel portion 4*b* from the lower end of housing 32. An annular gage ring 38 engages the exterior lower end of housing 32 and forms an upper abutment for the uppermost packing element 40*a*. Three packing elements 40*a*, 40*b*, and 40*c*, each of conventional annular construction, surround the packing element mandrel 42. Two packing elements separators 41 and 41 are positioned on opposite ends of the intermediate packing element 40*b*. The packing elements can comprise a conventional elastomeric material. If desired, the packing elements can be fabricated of elastomeric elements of different durometers. A lower gage ring 46 similar in construction to upper gage ring 38 is positioned in abutting relationship to the lower end of packing element 40*c* which comprises the lowermost of the upper set of three packing elements.

As shown in FIG. 1B, an inner injection port 4*d* extending through mandrel 4 establishes communication between the mandrel bore and the longitudinal bypass 36 formed around the exterior of mandrel 4. An outer ported section 48 (FIG. 1C) threadably secured at its upper end to gage ring 46 defines an exterior radial port 50 communicating between longitudinal bypass section 36 and the exterior of the tool immediately below the upper set of packing elements 40*a*, 40*b*, and 40*c*. The outer ported section 48 has an inner diameter which is greater than the inner diameter of the upper packing element mandrel 42 and which is also greater than the inner diameter of a lower packing element mandrel 58 secured to the lower end of the ported section 48 by threads 48*a*. Therefore the thickness of the longitudinal bypass longitudinally above and below the ported section 48 is less than the thickness of the bypass on the interior of ported section 48.

In the preferred embodiment of this invention, the inner mandrel 4 can comprise a plurality of threaded sections. A lower unloader seal support comprising a tubular metallic section 52 (FIG. 1C) having annular elastomeric sections 54 secured to the exterior thereof, is threadably secured between the sections 4*b* and 4*c* of mandrel 4. In the configuration shown in FIG. 1C, the lower unloader seals 54 can be positioned in the portion of the longitudinal bypass adjacent port 50. In this section of the longitudinal bypass, seals 54 do not engage an interior surface and the longitudinal bypass is continuous between the upper section 36 and a lower section 66.

Additionally, the unloader seal support 52 comprises a seal bore portion 52*a* immediately above a constricted bore portion 52*b*. The upwardly facing shoulder 4*g* thus defined provides a mounting for a wireline removable plug 94 having seal elements 94*b* and a fishing neck 94*a*. If desired, conventional locking type, wireline removable plug may be substituted for plug 94 which will facilitate selective swabbing of the perforations.

A gage ring 56 is secured to the lower end of ported section 48 by the threads 48*b* and abuts the upper end of the uppermost of three lower packing elements, 60*a*, 60*b*, and 60*c*. Each of these packing elements is conventional in nature and can be similar in construction to the corresponding packing elements 40*a*, 40*b*, and 40*c* located above the ported section 48. Similar packing elements separators 61*a* and 61*b* are located above and below the central packing element 60*b* of the lowermost set of three packing elements. These packing elements 60*a*, 60*b*, and 60*c* surround and engage the lower packing element mandrel 58 in the same manner that the upper packing elements 40*a*, 40*b*, and 40*c* engage the upper packing element mandrel 42. The lower section 66 of the longitudinal bypass extends between packing element mandrel 58 and the adjacent portion of the mandrel 4.

A lower gage ring 62 is secured by threads 62*a* to a tie sleeve 64 which comprises a cylindrical member defining the portion of the outer tool housing below packing elements 60. A radial port 68 extending through tie sleeve 64 establishes communication between the lower section 66 of the longitudinal bypass and the exterior of the tool.

An expander cone 70 is secured to the lower end of tie sleeve 64 by means of conventional threaded connection 70*a*. A rocker slip sleeve 72 is secured to the upper cone 70 by means of an annular snap ring 71. The rocker slip sleeve 72 has a plurality of grooves 72*a* located circumferentially therearound for receiving the inner portions of conventional rocker slips 74. Each of the several rocker slips 74 located circumferentially around the lower end of the injection tool is spring loaded relative to the lower end of the rocker slip sleeve 72 by a plurality of springs 76, which engage the inner surface of lower drag section 74*b* of the rocker slip. The rocker slip assembly, comprising a plurality of equally spaced rocker slips is held in position by a rocker slip retainer ring 75 located just above the rocker slip drag sections 74*b*. In the configuration shown in FIG. 1D, the springs 76 bias the lower section of the rocker slip outwardly so that drag section 74*b* is the outermost section of the injection tool.

The upper end 74*a* of each rocker slip 74 comprises a section having a serrated outer surface 74*c* and an inclined inner surface 74*d* opposed to a cooperable camming surface 70*b* on the lower end of cone 70. In the retracted configuration shown in FIGS. 1C and 1D, the rocker slips 74 are spaced from the cone 70. The lower end of the rocker slip 74 is captured by an outer lip 78*a* on sleeve 78 to hold the rocker slip 74 in the run-in position.

Figure 5:
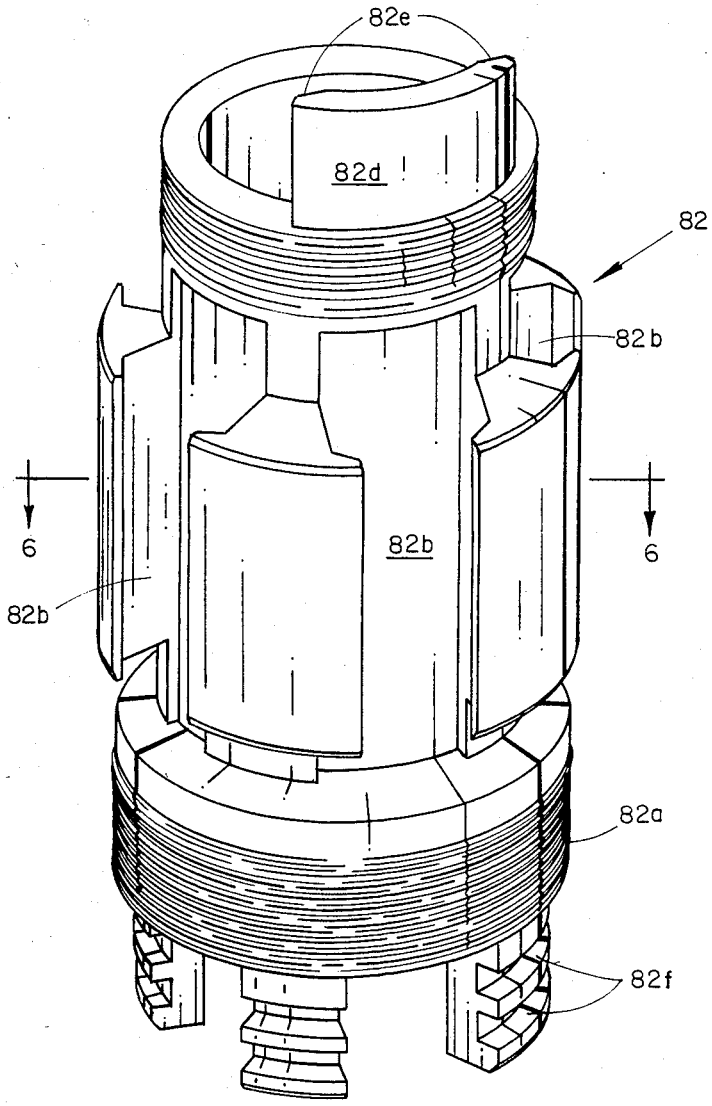
FIG. 5 is a perspective view of the drag block housing.
Figure 6:
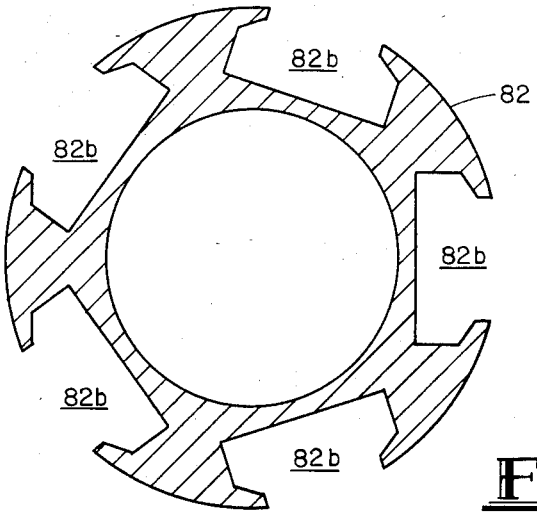
FIG. 6 is a sectional view taken on the plane 6—6 of FIG. 5.

Sleeve 78 is secured to a cross-over sleeve 80 by conventional threads 78*b*. The cross-over sleeve 80 is in turn secured to a drag block segment retainer housing 82 (FIG. 5) by threaded connections 80*a*. A plurality of peripherally spaced, longitudinal dove-tailed recesses 82*b* are provided in housing 82 to respectively accomodate drag blocks 83 which are urged outwardly by springs 87.

Figure 4B:
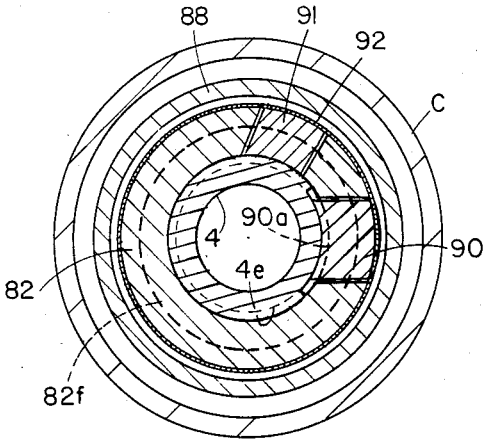
FIG. 4B is a sectional view taken on the plane 4B—4B of FIG. 2D.
Figure 4A:
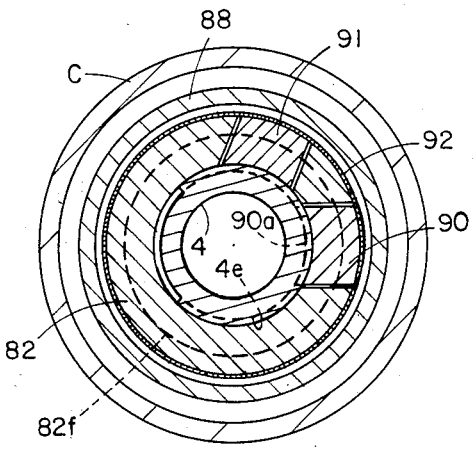
FIG. 4A is a sectional view taken on the plane 4A—4A of FIG. 1D

At the lower end of the housing 82, an outer lock segment retainer 88 is secured by threaded connection 82*a* to lock segment housing 82. A lock segment 90 having teeth 90*a* on its inner surface and a dummy lock segment 91 having no teeth are retained within the lock segment housing 82 by the outer retainer 88. Coil springs 92 (FIGS. 4A and 4B) extend circumferentially around the grooves 82*f* in housing 82 and the lock segments 90 and 91 to hold the segments in a radially retracted position. The horizontal teeth 90*a* on the inner surface of lock segment 90 engage cooperating horizontal grooves 4*e* extending partially around the lower portion of the mandrel 4 (FIG. 4A) to prevent axial movement of mandrel 4 relative to the rest of the tool.

The mandrel 4 may thus be released from the lock segment by limited angular rotation. The limit to the rotation is provided by an axial tab 82*d* (FIG. 5) on the top end of drag block housing 82 which engages a key 85 which is secured in a longitudinal slot 4*h* in the periphery of the mandrel 4 by the cross over sleeve 80. If the opposite direction of rotation of mandrel 4 is desired to release the mandrel to set the packer, then it is only necessary to reverse the positions of threaded lock segment 90 with unthreaded lock segment 91. A bevel 82*e* on each axial edge of tab 82 forces key 85 into slot 4*h* and improves the reliability of the key.

At the lower end of the mandrel 4, threads 4*h* provide a means for securing the mandrel 4 to a portion of the tubing string extending below the injection tool 2.

FIG. 2 shows the actuation of the injection tool 2 to permit injection of fluids through a single selected set of perforations, without injecting into closely adjacent perforations axially spaced from the selected perforations by distances of as little as 6 inches. As shown in FIG. 3, the upper set of packing elements 40 can be positioned above the selected set of perforations P while the lower set of packing elements 60 can be positioned below this same selected set of perforations. Expansion of packing elements 40 and 60 will then seal the annulus above and below the selected set of perforations and isolate the annular area surrounding the selected set of perforations from closely adjacent perforations above and below.

Figure 2B:
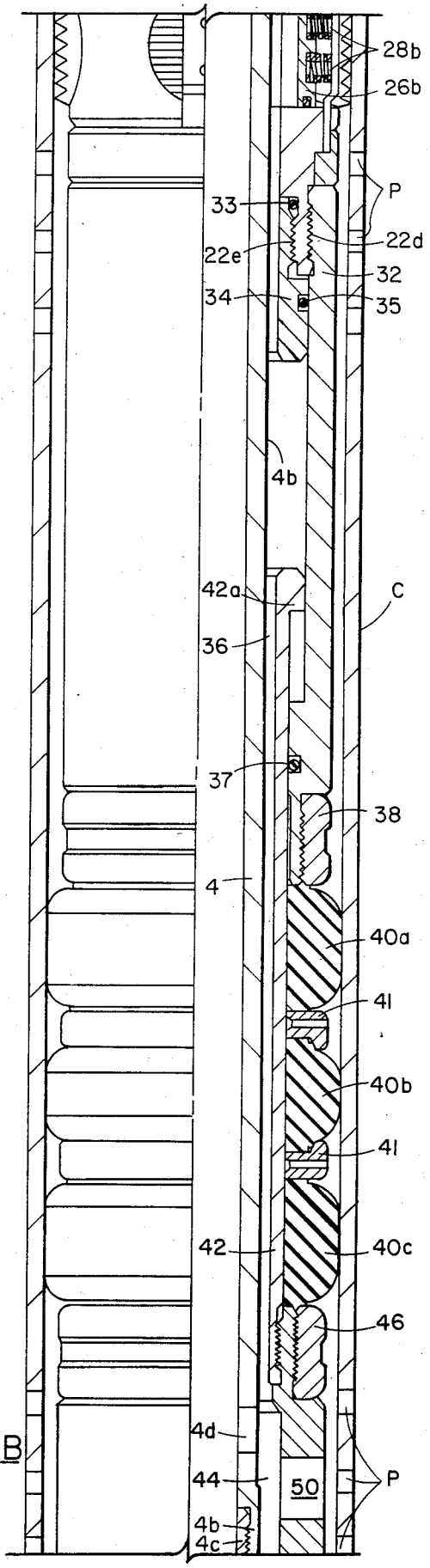

To position the injection tool 2 as shown in FIGS. 2A, 2B, 2C, and 2D the tool is lowered into a position adjacent the selected perforations P, with the tool in the configuration shown in FIGS. 1A, 1B, 1C and 1D. The lock segment 90 engagement with grooves 4*e* (FIG. 4A) prevents expansion of slips 74 and of the packing elements 40 and 60. When the outer injection port 50 has been positioned adjacent a designated set of perforations P as shown in FIG. 2B, partial rotation of the tubing T in a previous selected direction releases mandrel 4 for axial movement relative to the lock segment 90. As the tubing T is rotated, the grooves 4*e* are disengaged from lock segment 90 (FIG. 4B) to permit downward movement of the mandrel 4. During the partial rotation of the mandrel 4, the drag block section 74*b* of the rocker slips 74 and drag blocks 83 engage the casing C to prevent rotation of the lock segment and the lock segment housing relative to the casing.

Downward movement of mandrel 4 relative to the rocker slips 74 brings the inclined surface 70*b* of expander cone 70 into engagement with the lower surface of the slip portion 74*a* of the rocker slips. Slip portion 74*a* is thus firmly wedged into engagement with the casing and the teeth bite into the casing and prevent further downward movement of rocker slip 74 relative to the casing. Continued downward movement of the mandrel 4, after the slips 74 are firmly wedged into engagement with the casing, is transmitted through the upper unloading assembly which is shifted downwardly into engagement with seal compressor 16. This downward movement of the mandrel 4 is transmitted through the retainer housing 18 and the hydraulic hold-down receptacle 22 to outer housing 32. Downward force applied to inner mandrel 4 is thus transmitted to packing elements 40 and 60, which are compressed by continued downward movement of the mandrel 4 relative to the now stationary lower housing section 64. Thus, the compressive force applied to the packing elements 40 and 60 causes radial expansion of the packing elements into engagement with the casing to seal the annulus between the tubing T and the casing C.

Figure 2C:
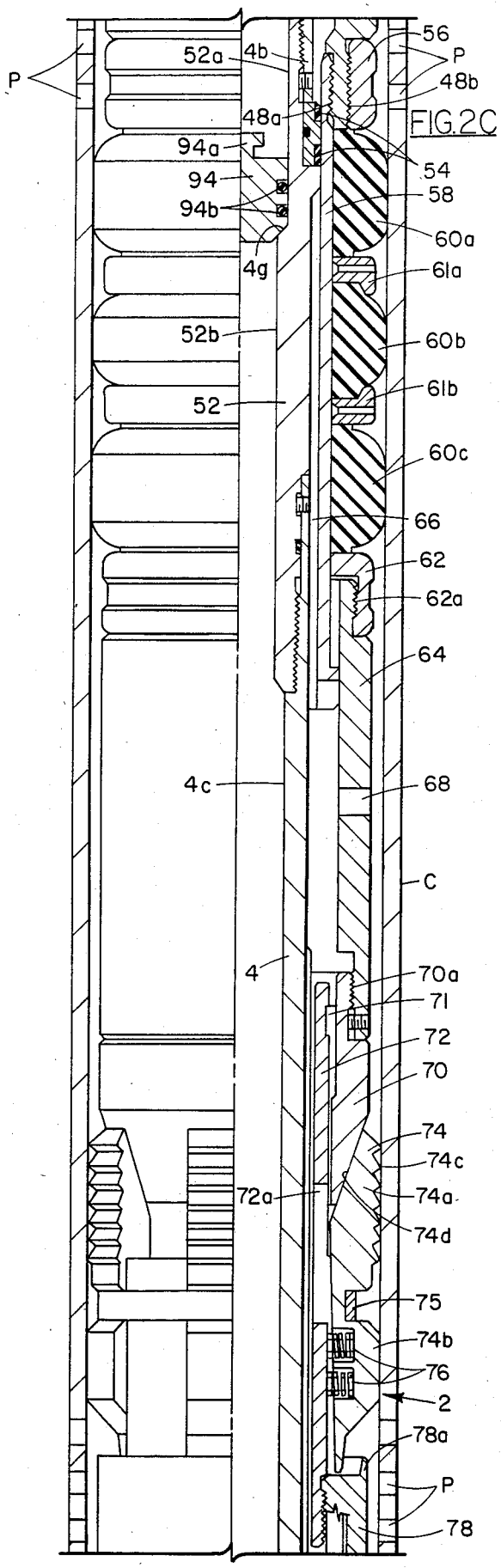
Figure 2D:
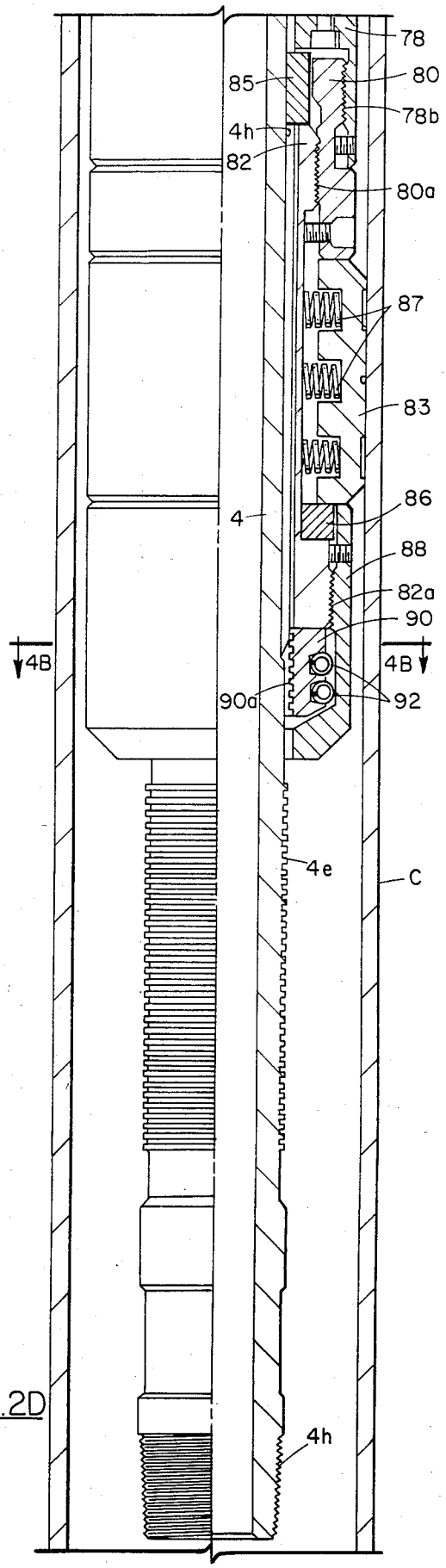
Figure 3:
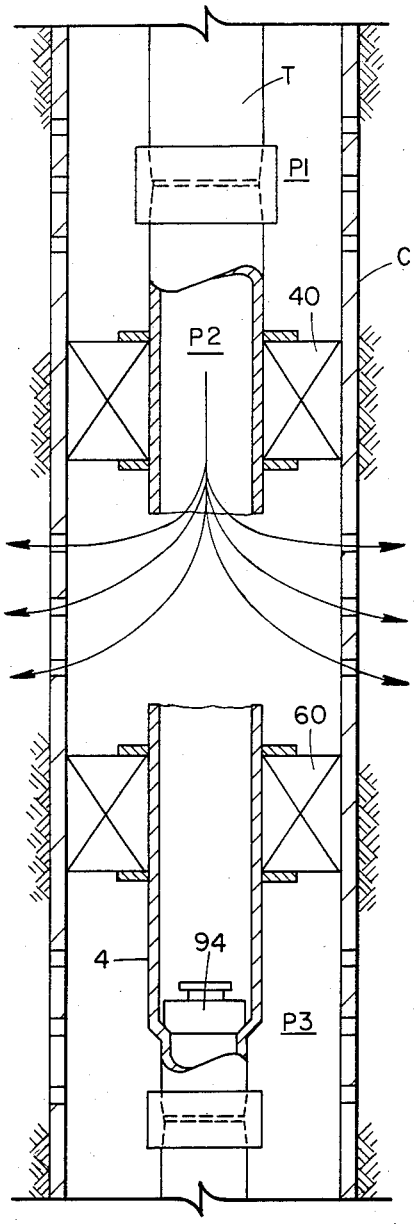
FIG. 3 is a schematic view illustrating the injection of fluids through the injection tool of FIGS. 2A through 2D into one of several closely adjacent formations.

The injection tool 2 is now in position to inject fluids through the selected perforations P adjacent the outer injection port 50. If not positioned in the tool as it is run into the well, the removable plug 94 can be positioned in engagement with mandrel seat 4*g* by conventional means. The removable plug 94 shown here can be lowered into the well by wireline means. With the plug in place and in engagement with seat 4*g*, fluid injected through the tubing would pass through mandrel port 4*d* into the longitudinal bypass upper section 36 adjacent the outer injection port 50. During setting of the injection tool, the lower seals 54 will have been shifted into a position in engagement with the more restricted portion of the longitudinal bypass 66, as shown in FIG. 2C. Thus, fluid cannot pass through the longitudinal bypass past seals 54. Fluid injected through mandrel port 4*d* cannot communicate with the annulus above packing elements 40 through longitudinal bypass portion 36 because the upper unloader seal 14 is held in engagement with the seal compressor 16 by the downward force applied to the mandrel 4. The injection pressure is, however, communicated through longitudinal bypass portion 36 to the balance sleeve 20. A differential pressure force equal to the difference between the injection pressure within longitudinal bypass 36 and the pressure in the annulus acting on balance sleeve 20 through port 18*a* acts across an area between seals 19 and 21. This pressure force shifts the balance sleeve 20 downwardly, maintaining it in engagement with the mandrel lug 4*c*. Thus any force due to injection pressure exceeding annulus pressure will act through balance sleeve 20 downwardly on mandrel 4 to insure that the mandrel stays in its downwardly shifted position.

Pressure of fluid injected through mandrel 4 will not act upwardly on the outer portion of the injection tool to release the tool since this pressure will act through longitudinal bypass portion 36 on the hydraulic hold-down buttons 26*a* and 26*b*. This pressure will shift the buttons outwardly, compressing springs 28*a* and 28*b*. In the preferred embodiment of this invention, the hydraulic hold-down members have serrated teeth 26*e* and these teeth engage the casing to secure the injection tool against upward movement.

In the event the annulus pressure below lower packing element 66 were to exceed the annulus pressure above the tool, this pressure would be transmitted through the open bottom end of the lower portion 4*c* of the mandrel 4 through port 4*d* into the upper section of the longitudinal bypass 36. Of course, the removable plug 94 would be unseated by this excess pressure existing below the tool. Thus, in the event of a greater pressure below than above the tool, this pressure would be transmitted through longitudinal bypass section 36 to act on the hydraulic hold-down buttons 26*a* and 26*b* in the manner just described. Thus, the tool will not be unseated or forced to move up the well bore.

The injection tool is fully retrievable and is resetable within the well. Thus, the tool 2 could be repeatedly shifted from the location of perforations through which fluid has just been injected and can be repositioned with the outer injection port in proximity to other perforations. Normal injection proceedure would involve positioning the injection tool adjacent the lower set of perforations and then sequentially repositioning the injection tool to inject at each subsequent set of perforations above the first set of perforations. At each subsequent set of perforations, the mandrel merely needs to be lowered to set the slip 74 and packing elements 40 and 60 as previously described. When the tool is shifted upwardly, the mandrel is moved in an upward direction. Thus, the compressive force supplied by the mandrel 4 to the packing elements 40 and 60 would be released and the cone 70 can be moved from beneath the slip portion 74*a* of the rocker slip 74.

The packing elements 40 and 60 would not tend to remain in their expanded configurations due to any pressure differential acting in the annulus across either set of packing elements. Upward movement of mandrel 4 will equalize the pressure across upper packing elements 40 by establishing communication between the annulus above the injection tool through longitudinal bypass section 36 and through the injection port 50 to the annulus below packing elements 40. Movement of the unloader seal 14 out of engagement with seal compressor 16, serves to establish such pressure equalization and pressure communication. After pressure is equalized across upper packing elements 40, as a result of movement of unloader seal 14 away from seal compressor 16, any pressure differential existing across packing element 60 can be relieved as the lower unloader seal 54 moves from within the restriction in lower bypass section 66 to the larger diameter portion proximate to outer injection port 50. A pressure equalization path is then established from the annulus below the packing element 60 through port 68, through the lower longitudinal bypass portion 66, through the injection port 50 to the annulus above lower packing element 60. This tool therefore provides an easily repeatable releasing procedure in which the mandrel 4 is merely manipulated in a longitudinal fashion to both release the packing elements 40 and 60 and the slips 74 and to equalize pressure across both sets of packing elements 40 and 60.

Lastly, the mandrel 4 may be partially rotated to re-engage grooves 4*e* with lock segment 90, thus permitting lowering of all the components of the tool to a new lower position.

Although the invention has been described in terms of a specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A tool for use in a well bore for producing hydrocarbons through a tubing string from subterranean hydrocarbon-bearing formations having a plurality of vertically spaced perforations therein, the tool comprising:

a tubular body assembly;

a plurality of radially expandable and retractable packing elements mounted in axially spaced relation on the tubular body assembly, each of said elements comprising means for sealing the annular area between the tubing string and the well bore upon radial expansion thereof;

a rigid mandrel assembly attachable to the tubing string, insertable in said tubular body assembly, and having a mandrel bore communicable with the tubing string;

at least one horizontal locking groove extending partially around the exterior of said mandrel;

means on the interior of said tubular body assembly defining a toothed segment engagable with said locking groove during run-in to secure said mandrel against movement relative to said tubular body assembly;

said mandrel being releasable from said tubular body assembly by limited angular movement relative to said tubular body assembly;

means for expanding and retracting said packing elements upon axial manipulation of the mandrel relative to said tubular body assembly;

a radial injection path communicable between the mandrel bore and the exterior of the tool, at least one upper packing element being above the injection path, and at least one lower packing element being below the radial injection path;

means for sealing the mandrel bore below the injection path; upper and lower pressure unloading means respectively above and below the radial injection path for separately equalizing the pressure differential across said packing elements above and below the injection path in response to axial manipulation of said mandrel, whereby successive perforations can be separately treated by injecting fluids through the tubing string and injection path; said upper and lower pressure-unloading means comprising an axially extending bypass communicable with the injection path, with an upper portion communicable to the exterior of the tool above the upper packing elements and with a lower portion communicable to the exterior of the tool below the packing elements, upper seal means shiftable between positions opening and closing the axially extending bypass upper portion and lower seal means being shiftable between positions opening and closing the axially extending bypass lower portion.

2. The tool of claim 1 wherein said means for sealing the mandrel bore is removable.

3. The tool of claim 1 wherein the axially extending bypass comprises an annular area surrounding the mandrel, the axially extending bypass having a first section having a greater thickness than a second section, the lower seal means being shiftable into the first section to open the axially extending bypass lower portion and the lower seal means being shiftable into said second section to close the longitudinal bypass lower section.

4. The tool of claim 1 wherein said axially extending bypass comprises an annular passage disposed intermediate said mandrel and said tubular body assembly.

5. The tool of claim 1 further comprising anchoring means for securing the tool in the well bore, the anchoring means including anchoring slips expandable into and retractable out of engagement with the well bore upon manipulation of the mandrel.

6. The tool of claim 5 wherein the anchoring means further comprises hydraulically expandable members responsive to fluid pressure in the axially extending bypass upper section in excess of fluid pressure on the exterior of the tool above the upper packing elements, the hydraulically expandable members being retractable when the upper seal means is shifted by manipulation of the mandrel to open the axially extending bypass upper section to the exterior of the tool.

7. The tool of claim 5 wherein said upper and lower seal means are shiftable by manipulation of the mandrel.

8. The tool of claim 7 wherein manipulation of the mandrel shifts the upper seal means to equalize the pressure differential across the packing elements above the injection path prior to sufficient movement of the lower seal means to equalize the pressure differential across the packing elements below the injection path.

9. The tool of claim 7 wherein said mandrel comprises a threaded assembly of at least two tubular elements, the lower element defining an internal shoulder supporting said means for sealing the mandrel bore; and said lower element additionally mounting a portion of said lower pressure-unloading means on its external surface.

10. A tool for use in a well bore for producing hydrocarbons through a tubing string from subterranean hydrocarbon-bearing formations having a plurality of vertically spaced perforations therein, the tool comprising:

a tubular body assembly;

a plurality of radially expandable and retractable packing elements mounted in axially spaced relation on the tubular body assembly, each of said elements comprising means for sealing the annular area between the tubing string and the well bore upon radial expansion thereof;

a rigid mandrel assembly attachabale to the tubing string, insertable in said tubular body assembly, and having a mandrel bore communicable with the tubing string, said mandrel assembly having an upper section and a lower section;

releasable means for securing said mandrel to said tubular body assembly for run-in;

said mandrel being releasable from said tubular body assembly by limited angular movement relative to said tubular body assembly;

means for expanding and retracting said packing elements upon axial manipulation of the mandrel relative to said tubular body assembly;

a radial injection path communicable between the mandrel bore and the exterior of the tool, at least one upper packing element being above the injection path, and at least one lower packing element being below the radial injection path;

means for sealing the mandrel bore below the injection path;

upper and lower pressure-unloading means respectively above and below the radial injection path for separately equalizing the pressure differential across said packing elements above and below the injection path in response to axial manipulation of said mandrel; said upper and lower pressure-unloading means comprising an axially extending bypass communicable with the injection path, with an upper portion communicable to the exterior of the tool above the upper packing elements and with a lower portion communicable to the exterior of the tool below the lower packing elements, upper seal means shiftable between positions opening and closing the axially extending bypass upper portion and lower seal means shiftable between positions opening and closing the axially extending bypass lower portion;

said lower mandrel section mounting a portion of said lower pressure-unloading means on its external surface, whereby successive perforations can be separately treated by injecting fluids through the tubing string and injection path, and hydrocarbons can be subsequently produced through the well tool with the packing elements sealing the tubing string and the well bore above the perforations.

11. The tool of claim 10 wherein the axially extending bypass comprises an annular area surrounding the mandrel, the said bypass having a first section having a greater thickness than a second section, the lower seal means being shiftable into the first section to open the axially extending bypass lower portion, and the lower seal means being shiftable into said second section to close the axially extending bypass lower section.

12. The tool of claim 10 wherein said axially extending bypass comprises an annular passage disposed intermediate said mandrel and said tubular body assembly.

13. The tool of claim 10 wherein said upper and lower seal means are shiftable by manipulation of the mandrel.

14. The tool of claim 13 wherein manipulation of the mandrel shifts the upper seal means to equalize the pressure differential across the packing elements above the injection path prior to sufficient movement of the lower seal means to equalize the pressure differential across the packing elements below the injection path.

15. The tool of claim 10 further comprising anchoring means for securing the tool in the well bore, the anchoring means including anchoring slips expandable into and retractable out of engagement with the well bore upon manipulation of the mandrel.

16. The tool of claim 15 wherein the anchoring means further comprises hydraulically expandable members responsive to fluid pressure in the axially extending bypass upper section in excess of fluid pressure on the exterior of the tool above the upper packing elements, the hydraulically expandable members being retractable when the upper seal means is shifted by manipulation of the mandrel to open the axially extending bypass upper section to the exterior of the tool.

17. A subsurface injection tool attacable to a tubing string insertable into a well bore for use in injecting fluids through selected subsurface perforations into a formation in a subterranean oil or gas well, comprising:

a tubular body assembly;

upper expandable packing element means on said tubular body assembly positionable above the selected perforations for establishing sealing integrity in the annular area between the tubing and the well bore;

lower expandable packing element means on said tubular body assembly positionable below the selected perforations for establishing sealing integrity in the annular area between the tubing and the well bore;

a mandrel attachable to the tubing string extending through the tubular body assembly and said upper and lower packing element means, and having a mandrel bore communicable with the tubing string;

horizontal locking grooves extending partially around the exterior of said mandrel;

means on the interior of said tubular body assembly defining a toothed segment engagable with said locking grooves to secure said mandrel against axial movement relative to said tubular body assembly;

said mandrel being releasable from said tubular body assembly by limited angular movement relative to said tubular body assembly;

means for expanding and retracting said packing elements by axial manipulation of said mandrel relative to said tubular body assembly;

an axially extending bypass between the mandrel and the upper and lower packing element means communicable with the annular area above and below the injection tool;

an outer injection port between the upper and lower packing element means communicable with the axially extending bypass;

an inner port in said mandrel communicable with said outer injection port;

an upper bypass seal shiftable by said mandrel into and from a position closing communication through the axially extending bypass between said inner port and the annular area above the injection tool;

a lower bypass seal shiftable into and from a position closing communication through the axially extending bypass between said inner port and the annular area below the injection tool; and a plug removably positionable in the mandrel below said inner port to close the mandrel bore, whereby fluids can be injected through the tubing string into the designated perforations when the axially extending bypass is closed and pressure differentials across the upper packing elements between the designated perforations and the annular area above the injection tool or across the lower packing elements between the designated perforations and the annular area below the injection tools can be separately equalized by shifting the upper and lower bypass seals to open the axially extending bypass.

18. The injection tool of claim 17 wherein the upper and lower bypass seals are shiftable from positions closing the axially extending bypass upon longitudinal movement of the mandrel, the upper bypass seal being shiftable to open the bypass between said inner port and the annular area above the injection tool prior to movement of the lower bypass seal sufficient to open the bypass between the inner injection port and the annular area below the injection tool.

19. The tool of claim 17 wherein said mandrel comprises a threaded assembly of at least two tubular elements, the element below the uppermost element defining an internal shoulder supporting said removable plug; and said element below the uppermost element additionally mounting a portion of said lower bypass seal on its external surface.

20. The tool of claim 17 wherein said axially extending bypass comprises an annular passage disposed intermediate said mandrel and said tubular body assembly.

* * * * *